US006581220B2

(12) United States Patent
Yekutiely et al.

(10) Patent No.: US 6,581,220 B2
(45) Date of Patent: Jun. 24, 2003

(54) METHOD AND APPRATUS FOR AROMATHERAPY SHOWER

(76) Inventors: David Yekutiely, 24 Sheshet Hayamim St., Ramat Hasharon 47247 (IL); Barak Yekutiely, 1278 Wellington Ave., Teaneck, NJ (US) 07666

( * ) Notice: Subject to any disclaimer, the term of this patent is extended or adjusted under 35 U.S.C. 154(b) by 31 days.

(21) Appl. No.: 09/843,742

(22) Filed: Apr. 30, 2001

(65) Prior Publication Data

US 2002/0158138 A1 Oct. 31, 2002

(51) Int. Cl.[7] ..... A47K 4/00
(52) U.S. Cl. ..... 4/661; 4/597; 4/665

(58) Field of Search ..... 4/597, 661, 665

(56) References Cited

U.S. PATENT DOCUMENTS 4,432,103 A * 2/1984 Hunziker ..... 4/597
5,293,654 A * 3/1994 Castwall et al. ..... 4/597
5,353,448 A * 10/1994 Lee ..... 4/597

* cited by examiner

*Primary Examiner*—Charles E. Phillips
(74) *Attorney, Agent, or Firm*—David Klein; Dekel Patent Ltd.

(57) ABSTRACT

A method for aromatherapy including recirculating shower water on a body of a bather, the shower water including at least one aromatherapy substance.

8 Claims, 2 Drawing Sheets

METHOD AND APPRATUS FOR AROMATHERAPY SHOWER

FIELD OF THE INVENTION

The present invention relates generally to aromatherapy and particularly to shower apparatus and methods for aromatherapy.

BACKGROUND OF THE INVENTION

Aromatherapy encompasses a variety of methods for delivering therapeutic benefits of essential oils or base oils of aromatic botanical extracts to the body. One type of aromatherapy involves mixing the aromatic extracts with water for bathing. Bathing with aromatic extracts is well known to provide many types of medicinal benefits. For example, therapeutic bath salts are well known for the relaxation of muscles, elimination or reduction of muscle spasms, and for the overall enhancement of a person's skin and mood. Examples of aromatic botanical extracts used in aromatherapy include, but are not limited to, jojoba oil (a base oil that has a chemical makeup very similar to the naturally occurring sebum in skin), rosewood oil, ylang-ylang oil, lavender oil, patchouli oil and grape seed extract. A bather generally mixes the aromatic extracts with water in a bathtub, and soaks in the tub for a period of time. By resting in the tub, the user accrues the combined benefits of external therapy and internal therapy, such as soothing or relaxing the body, or conditioning or otherwise improving the health of skin, to name a few.

Aromatherapy showers are also known. For example, U.S. Pat. Nos. 5,915,622 to Foote and 5,957,379 to McMorrow, et al. both describe shower apparatus for delivering aromatic extracts in a water stream to a person taking a shower. These patents deal with the problem of mixing aromatic botanical extracts with mineral salts in a water stream. The problem is that if botanical extracts are exposed to mineral salts for a prolonged period of time, the mineral salts may cause oxidation of the extracts. This oxidation of the extracts eliminates a majority of the value and benefit of the aromatic character of the extracts.

The Foote and McMorrow, et al. patents provide a combination spa fixture that is mounted between an inlet pipe and a shower head. The fixture includes a container for mixing a stream of water with additives. A portion of the stream of water passing from the inlet pipe to the shower head is diverted into the container. The container includes a replaceable cartridge that has a first additive, such as aromatic botanical extracts, in a first chamber and a second additive, such as mineral salts, in a second chamber. The diverted stream of water mixes with the aromatic botanical extracts in the first chamber, passes through a screen to the second chamber, and mixes with the mineral salts in the second chamber. The diverted stream containing both aromatic botanical extracts and mineral salts is then returned to the main stream of water, which exits the shower head. A control valve controls the amount of additives added to the main stream of water. Thus, the two additives are kept separate from one another, thereby preventing a chemical reaction between the additives that would cause a loss of potency.

However, the Foote and McMorrow, et al. patents are disadvantageous compared to bathtub aromatherapy. First, as mentioned above, bathtub aromatherapy provides benefits by the bather resting in the tub and soaking in the aromatic extracts. In contrast, the water flowing in the shower generally does not linger long enough on the body to provide the same degree of benefits as in a tub. Second, the shower is more wasteful of water and aromatic extracts than bathtub aromatherapy.

SUMMARY OF THE INVENTION

The present invention seeks to provide improved shower apparatus and methods for aromatherapy. The present invention includes an add-on system for showers that provides numerous health benefits, and at the same time provides significant savings in water and energy resources.

The system of the present invention recirculates the shower water in a novel manner by means of a vacuum pump. The pump serves as a pressure and flow booster for a normal shower. The system can recirculate the shower water and provide water flow from a regular shower faucet with a single flow pipe, without any need for extra piping. The system can recycle the shower water through an existing shower head at high pressure with a minimum amount of water. The system also includes temperature control apparatus that is capable of maintaining the recycled shower water at a constant temperature, or varying the temperature in accordance with a user preference.

In a preferred embodiment, the invention may be used as an aromatherapy shower, by placing a small amount of aromatherapy substances in the shower water. The recirculating shower water easily penetrates skin pores and may be directed to all parts of the body. The benefits of the aromatherapy may be combined with other features. For example, the recirculating shower water may be heated to a high temperature to provide a combination of steam and aromatherapy for a synergistic sauna-aromatherapy shower experience The invention may also be used as a hydrotherapy shower, wherein the existing shower-head may direct a flexible, high-powered hydrotherapy jet of water (which may be mixed with aromatherapy substances) to all parts of the body. The invention may be used as a lathering shower with just a few drops of shampoo introduced into the recirculating shower water.

Any kind of aromatherapy substance may be used, such as, but not limited to essential oils (such as those mentioned hereinabove), dead-sea mud-packs (for achieving significant alleviation of various joint diseases, for example), dead-sea sulfur packs (for treatment of soft tissue rheumatism and for relief of muscular pain, for example), or dead-sea salt packs (for treatment of certain skin ailments, for example).

The prior art aromatherapy shower may normally last 20 minutes and consume 200 liters of water. In contrast, the present invention can provide significant improvements in aromatherapy with a small amount of water (e.g., just 20–30 liters of water, although the invention is not limited to these values), and unlimited shower time.

The system of the present invention may be initially operated as a normal shower, wherein water flows from the shower faucet to the shower head via a vertical conduit, and the excess water exits through the drain hole located at the bottom of the bathtub. During normal showering, the vertical conduit may sit on the bathtub (or shower stall) floor or may be sealingly placed in the bathtub drain hole.

The vertical conduit comprises a one-way valve situated near the bottom of the conduit, below the inlet of the main water flow into the conduit. As long as there is positive water pressure from the faucet, the water flows through the vertical conduit by means of two pressures: the positive pressure from the faucet that pushes the water flow through the conduit, plus the negative sucking pressure from the booster pump that pulls the water flow through the conduit. The positive pressure of the main water flow is sufficiently stronger than the sucking force of the pump so that the one-way valve remains closed during the normal shower mode of operation. The vertical conduit has openings below the one-way valve, such that water that has accumulated on the floor of the bathtub may enter the conduit. However, in the normal shower mode of operation this water does not flow past the one-way valve, which is closed.

During normal showering, a bather may adjust the water temperature and flow with appropriate valves and controls. The vacuum booster pump may start operating automatically at the beginning of the normal shower, such as by means of a water pressure switch.

The bather may switch to a water recirculating or health shower mode. In this mode, the drain hole is plugged, and a timer valve (or flow meter device) shuts off the main water flow after a preset period of time (such as a matter of seconds) that is sufficient for water to pool around the vicinity of the bottom openings of the vertical conduit. The water flow may be stopped from the main (faucet) water supply either automatically by the timer valve or may even be stopped manually. As soon as the main water flow is closed off, the water continues to flow in the conduit due to the negative sucking pressure from the booster pump that pulls the water flow through the conduit. In the absence of the positive main water pressure, the sucking pressure opens the one-way valve. The bather thus does not feel any difference in water flow between the regular shower mode and the recirculating mode.

At any point in the health shower mode, the bather may add any additive to the recirculating shower, such as shampoo, aromatherapy substances or mineral salts, or any kind of health care product, for example. These materials are recirculated with the water, with the result that the bather is constantly bathed with aromatherapy water as if he/she were sitting in a bathtub. Thus, the bather can derive all the benefits of aromatherapy with a minimal amount of water and aromatherapy substances. In the case of shampoo or soap, the recirculating action causes the shampoo or soap to lather as it exits the shower head. Thus, the bather can lather with recirculating shampoo or soap, thereby freeing his/her hands during the lathering action.

After having enjoyed the benefits of the health shower mode, the bather may return to the regular shower mode for final rinsing. In the regular shower mode, the user may purge and clean the piping of the system with fresh water or water mixed with a cleaner or antiseptic solution, for example.

There is thus provided in accordance with a preferred embodiment of the present invention a method for aromatherapy including recirculating shower water on a body of a bather, the shower water including at least one aromatherapy substance.

In accordance with a preferred embodiment of the present invention the method further includes controlling a flow and/or a temperature of the shower water.

Further in accordance with a preferred embodiment of the present invention the method includes selecting between applying a recirculating flow of shower water on the body of the bather and applying a non-recirculating flow of water on the body of the bather.

Still further in accordance with a preferred embodiment of the present invention the recirculating and non-recirculating flows of shower water are arranged to flow through a single common conduit.

Additionally in accordance with a preferred embodiment of the present invention the shower water is heated to a sufficiently high temperature to provide a combination of sauna steam and the at least one aromatherapy substance.

In accordance with a preferred embodiment of the present invention a hydrotherapy jet of the shower water may be directed on the body of the bather.

There is also provided in accordance with a preferred embodiment of the present invention apparatus for aromatherapy including shower water including at least one aromatherapy substance, and recirculation apparatus in fluid communication with the shower water, adapted to recirculate the shower water on a body of a bather.

In accordance with a preferred embodiment of the present invention the recirculation apparatus includes a conduit, a one-way valve disposed in the conduit, a pump (preferably a vacuum pump) in fluid communication with a portion of the conduit distanced from the one-way valve, a shower head in fluid communication with the pump, and a main-water fluid inlet at a portion of the conduit between the one-way valve and the pump, the main-water fluid inlet adapted to be in fluid communication with a main water supply.

Further in accordance with a preferred embodiment of the present invention the conduit is formed with at least one opening at a portion of the conduit such that the one-way valve is positioned between the at least one opening and the main-water fluid inlet.

Still further in accordance with a preferred embodiment of the present invention a pressure switch is adapted to control an operation of the pump, and a timer valve is adapted to shut off flow into the main-water fluid inlet after a preset period of time.

In accordance with a preferred embodiment of the present invention a controller is adapted to control a flow of the shower water.

Further in accordance with a preferred embodiment of the present invention temperature control apparatus is adapted to control a temperature of the shower water.

BRIEF DESCRIPTION OF THE DRAWINGS

The present invention will be understood and appreciated more fully from the following detailed description taken in conjunction with the drawings in which.

DETAILED DESCRIPTION OF A PREFERRED EMBODIMENT

Figure 1:
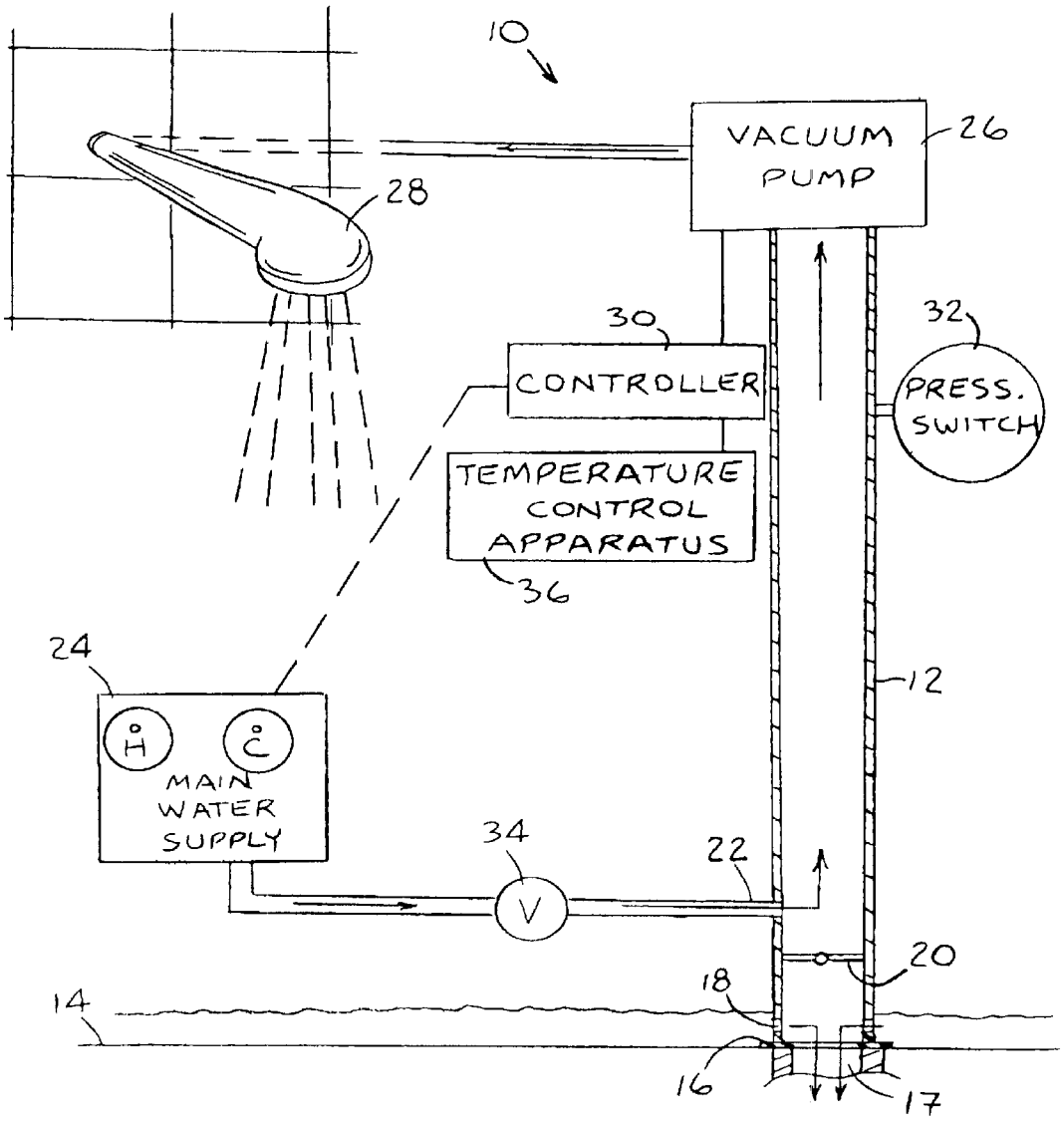
FIGS. 1 and 2 are simplified pictorial illustrations of apparatus for aromatherapy, constructed and operative in accordance with a preferred embodiment of the present invention, in respective normal and recirculating shower modes of operation.

Reference is now made to FIG. 1, which illustrates apparatus 10 for aromatherapy, constructed and operative in accordance with a preferred embodiment of the present invention.

Apparatus 10 preferably includes recirculation apparatus that comprises a conduit 12 configured to stand generally vertically with respect to a bathtub (or shower stall) floor 14. Conduit 12 may be provided with a device for attachment to the bathtub floor 14, such as an elastomeric cup 16 that may sit in a drain hole 17. Conduit 12 is hollow and has one or more openings 18 formed near a bottom end thereof, such that water may enter conduit 12 through openings 18.

A one-way valve 20 is preferably disposed in conduit 12 near and above openings 18. A main-water fluid inlet 22 is preferably formed at a portion of conduit 12, and is in fluid communication with a main water supply 24, such as a faucet or the like. One-way valve 20 is positioned between openings 18 and main-water fluid inlet 22. A pump 26, preferably a vacuum pump, is in fluid communication with a portion of conduit 12 distanced from one-way valve 20, such as near an upper end of conduit 12. Although FIG. 1 illustrates main-water fluid inlet 22 connected at an angle to conduit 12, main-water fluid inlet 22 and conduit 12 may comprise one continuous pipe with one-way valve 20 positioned anywhere between the main water supply 24 and pump 26. A shower head 28 is in fluid communication with pump 26.

A controller 30 may be provided that controls flow of the shower water. Control 30 may comprise any necessary sensors, valves and switches for controlling the shower water flow. For example, a water pressure switch 32 may be provided for sensing the pressure of the water flowing through conduit 12. A timer valve 34 may be provided adapted to shut off the main water supply flow. Temperature control apparatus 36 may be provided for maintaining the shower water at a constant temperature, or varying the temperature in accordance with a user preference. Temperature control apparatus 36 may heat the water in any convenient manner, such as directly heating the water or the conduit 12, or by means of tubing (not shown) which diverts the water flow from the conduit 12 to apparatus 36 for heating and returns the flow back to the conduit 12 by suitable tubing (not shown). Temperature control apparatus 36 may maintain the temperature of the water as selected by the user when initially turning on the water flow for the shower.

Apparatus 10 may be initially operated as a normal shower, as shown in FIG. 1. In such a mode of operation, water flows from the main water supply 24 and enters conduit 12 through main-water fluid inlet 22. Pump 26, which acts as a booster pump, may start operating automatically at the beginning of the normal shower, such as by means of a water pressure switch. The water flows up through conduit 12 to shower head 28. Water exits shower head 28 as a spray or jet, depending on the shower head, and any excess water exits through the drain hole 17 on the bathtub (or shower stall) floor 14. During normal showering, conduit 12 may sit on floor 14 (wherein water flows directly to drain hole 17) or may be sealingly placed in drain hole 17 (wherein water flows to drain hole 17 via openings 18).

As long as there is positive water pressure from the main water supply 24, the water flows through conduit 12 by means of two pressures: the positive pressure from the main water supply 24 that pushes the water flow through conduit 12, plus the negative sucking pressure from pump 26 that pulls the water flow through conduit 12. The positive pressure of the main water supply 24 is sufficiently stronger than the sucking force of pump 26 so that one-way valve 20 remains closed during the normal shower mode of operation. Water that has accumulated on floor 14 may enter conduit 12 through openings 18, but since one-way valve 20 is closed, the water does not flow up conduit 12.

During normal showering, a bather may adjust the water temperature and flow with controller 30. The bather may switch from the normal shower mode to a water recirculating mode, such as by means of appropriate control buttons (not shown) on controller 30.

Figure 2:
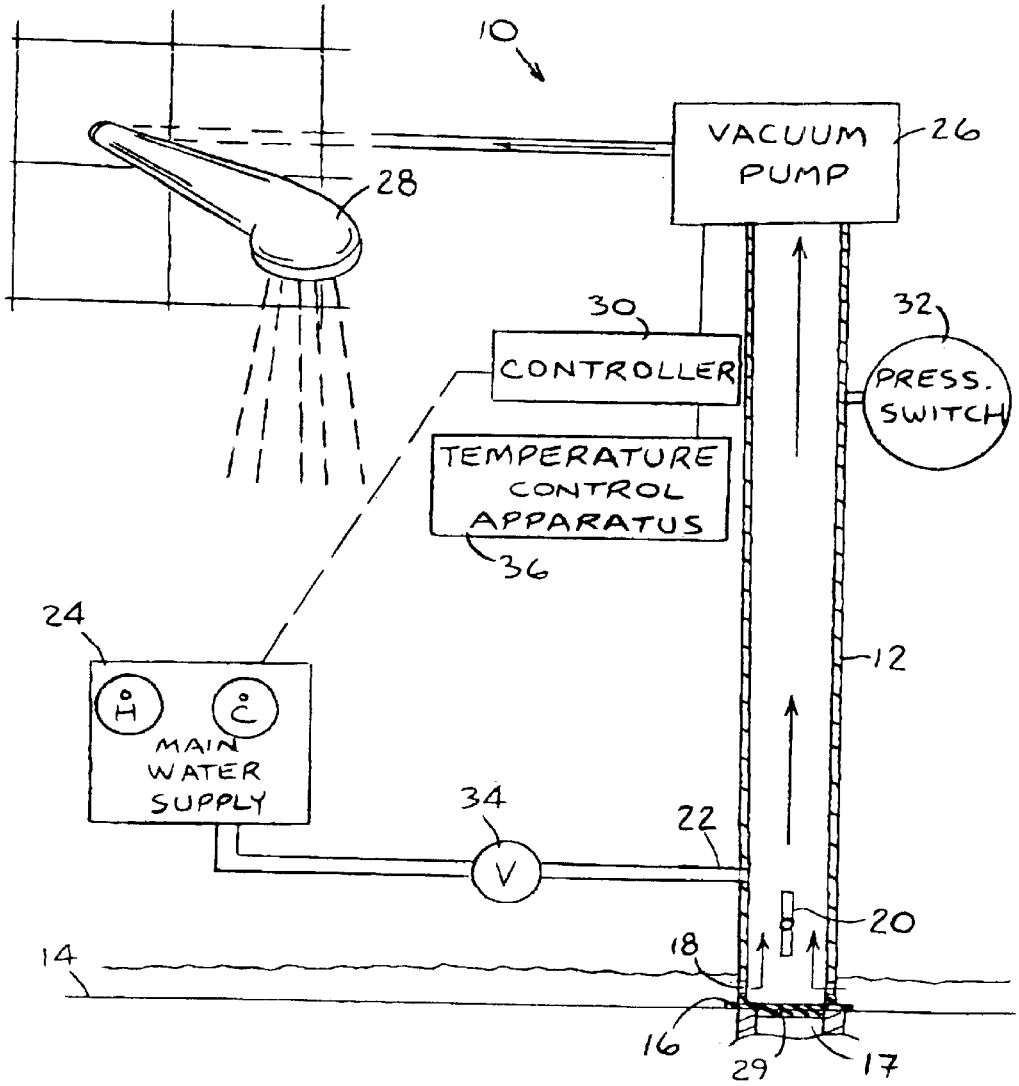

Reference is now made to FIG. 2, which illustrates apparatus 10 in the recirculating mode, also referred to as the health shower mode. In this mode, drain hole 17 is plugged with a plug 29, and controller 30 (which may comprise a timer valve or flow meter device or equivalent apparatus, not shown) shuts off the main water flow after a preset period of time (such as a matter of seconds) that is sufficient for water to pool around the vicinity of openings 18. The water flow may be stopped from the main water supply 24 either automatically by controller 30 or may be stopped manually. As soon as the main water flow is closed off, the water continues to flow in conduit 12 due to the negative sucking pressure from pump 26 that pulls the water flow through conduit 12. In the absence of the positive main water pressure, the sucking pressure opens one-way valve 20.

At any point in the health shower mode, the bather may add one or more additives 40 to the recirculating shower, such as shampoo, aromatherapy substances or mineral salts or any kind of health care product, for example. The additives 40 are recirculated with the water, with the result that the bather is constantly bathed with aromatherapy water as if he/she were sitting in a bathtub. Thus, the bather can derive all the benefits of aromatherapy with a minimal amount of water and aromatherapy substances. In the case of shampoo or soap, the recirculating action causes the shampoo or soap to lather as it exits shower head 28. Thus, the bather can lather with recirculating shampoo or soap, thereby freeing his/her hands during the lathering action.

The bather can switch from the recirculating mode back to the normal shower mode (such as for rinsing off before exiting the shower) or vice versa at will. The shower water may be heated to a sufficiently high temperature to provide a combination of sauna steam and aromatherapy. The shower head 28 may be used to direct a hydrotherapy jet of shower water mixed with aromatherapy substances on the body of the bather, if desired.

The recirculation apparatus of the present invention may be a built-in feature of a bathtub/shower or any bathing installation, such as being hidden behind a shower wall, for example. The recirculation apparatus may be sold as a complete system embedded in an add on shower stall, such as is commonly sold as "luxury showers".

It will be appreciated by person skilled in the art, that the present invention is not limited by what has been particularly shown and described herein above. Rather the scope of the present invention is defined only by the claims that follow:

What is claimed is:

1. A method comprising:

providing recirculation apparatus that comprises a conduit, a one-way valve disposed in said conduit, a vacuum pump in fluid communication with a portion of said conduit distanced from said one-way valve, a shower head in fluid communication with said pump, and a main-water fluid inlet at a portion of said conduit between said one-way valve and said pump, said main-water fluid inlet being in fluid communication with a main water supply, and said conduit being formed with at least one opening at a portion of said conduit such that said one-way valve is positioned between said at least one opening and said main-water fluid inlet;

initially operating in a normal shower mode, wherein shower water flows from said main water supply to said shower head via said conduit, and excess water exits to a drain hole, and wherein as long as there is positive water pressure from said main water supply, water flows through said conduit by means of positive pressure from said main water supply and negative sucking pressure from said pump and said one-way valve remains closed; and switching to a water recirculating mode, wherein water is shut off from said main water supply water, and water continues to flow in said conduit due to the negative sucking pressure from said pump, wherein in an absence of the positive water pressure, the sucking pressure opens said one-way valve, and wherein water exits said shower head and recirculates through said conduit via said at least one opening.

2. The method according to claim 1 and further comprising controlling a flow of said shower water.

3. The method according to claim 1 and further comprising controlling a temperature of said shower water.

4. The method according to claim 1 and further comprising selecting between applying a recirculating flow of shower water on the body of the bather and applying a non-recirculating flow of water on the body of the bather.

5. The method according to claim 4 and further comprising arranging said recirculating and non-recirculating flows of shower water to flow through a single common conduit.

6. The method according to claim 1 and further comprising heating said shower water to a sufficiently high temperature to provide a combination of sauna steam and said at least one aromatherapy substance.

7. The method according to claim 1 and further comprising directing a hydrotherapy jet of said shower water on the body of the bather.

8. A method according to claim 1, wherein said shower water comprises at least one aromatherapy substance.

* * * * *